US005653674A

United States Patent [19]

Leung

[11] Patent Number: 5,653,674

[45] Date of Patent: Aug. 5, 1997

[54] DECANTER CENTRIFUGE WITH DISCHARGE OPENING ADJUSTMENT CONTROL AND ASSOCIATED METHOD OF OPERATING

[75] Inventor: Woon-Fong Leung, Sherborn, Mass.

[73] Assignee: Baker Hughes Incorporated, Houston, Tex.

[21] Appl. No.: 622,736

[22] Filed: Mar. 27, 1996

[51] Int. Cl.[6] ..... B04B 1/20; B04B 11/02

[52] U.S. Cl. ..... 494/53; 494/57

[58] Field of Search ..... 494/52–54, 56, 494/57; 210/380.1, 380.3

[56] References Cited

U.S. PATENT DOCUMENTS

| | | | |
|---|---|---|---|
| 273,037 | 2/1883 | Decastro et al. . | |
| 3,404,833 | 10/1968 | Pause . | |
| 3,454,216 | 7/1969 | Hemfort . | |
| 3,623,656 | 11/1971 | Lavanchy . | |
| 3,934,792 | 1/1976 | High . | |
| 3,955,756 | 5/1976 | Hiller . | |
| 4,339,072 | 7/1982 | Hiller . | |
| 4,378,906 | 4/1983 | Epper et al. | 494/53 X |
| 4,615,690 | 10/1986 | Ecker . | |
| 4,718,886 | 1/1988 | Mackel . | |
| 4,729,830 | 3/1988 | Suzuki . | |
| 4,731,182 | 3/1988 | High . | |
| 4,764,163 | 8/1988 | Caldwell . | |
| 4,784,634 | 11/1988 | Schiele | 494/56 X |
| 4,950,219 | 8/1990 | Luchetta . | |
| 5,169,377 | 12/1992 | Schlip et al. | 494/53 X |
| 5,182,020 | 1/1993 | Grimwood . | |
| 5,217,428 | 6/1993 | Schlip et al. . | |
| 5,252,209 | 10/1993 | Retter . | |
| 5,257,968 | 11/1993 | Caldwell | 494/56 X |
| 5,261,869 | 11/1993 | Caldwell . | |
| 5,328,441 | 7/1994 | Carr . | |

FOREIGN PATENT DOCUMENTS

| | | | |
|---|---|---|---|
| 41 19 003 A1 | 12/1992 | Germany . | |
| 4-310255(A) | 11/1992 | Japan . | |
| 655433 | 4/1979 | U.S.S.R. | 494/56 |
| 745543 | 7/1980 | U.S.S.R. | 494/53 |
| 1622015 A1 | 7/1988 | U.S.S.R. . | |

*Primary Examiner*—Charles E. Cooley

*Attorney, Agent, or Firm*—McAulay Fisher Nissen Goldberg & Kiel, LLP

[57] ABSTRACT

A decanter centrifuge comprises a bowl having a plurality of cake discharge openings at one end and a liquid phase discharge opening. The bowl is rotatable about a longitudinal axis, while the cake discharge openings are disposed in a plane oriented transversely relative to the longitudinal axis. The bowl has a cylindrical portion and a beach portion between the cylindrical portion and the cake discharge openings. A conveyor is disposed at least partially inside the bowl for rotation about the longitudinal axis at an angular speed different from an angular rotational speed of the bowl. The conveyor includes a helical screw disposed inside the bowl for scrolling a deposited solids cake layer along an inner surface of the bowl towards the cake discharge openings. A feed element extends into the bowl and the conveyor for delivering a feed slurry into a pool inside the bowl. Pursuant to the invention, a flow control structure is provided on the bowl at the cake discharge openings for varying a cross-sectional area of the cake discharge openings to selectively impede a flow of cake along the bowl towards the cake discharge openings, thereby obtaining the desired cake dryness.

18 Claims, 6 Drawing Sheets

DECANTER CENTRIFUGE WITH DISCHARGE OPENING ADJUSTMENT CONTROL AND ASSOCIATED METHOD OF OPERATING

BACKGROUND OF THE INVENTION

This invention relates to a decanter centrifuge. More specifically, this invention relates to a decanter centrifuge with structure for controlling the rate of cake discharge to thereby control cake moisture content. This invention also relates to an associated method for operating a decanter centrifuge.

A decanter centrifuge generally includes an outer bowl, an inner hub carrying a worm conveyor, a feed arrangement for slurry to be processed, and discharge ports for cake solids and clarified liquid. The bowl includes a cylindrical section and a conical beach section. The bowl and the hub are rotated at high, slightly different angular speeds so that heavier solid particles of a slurry introduced into the bowl are forced by centrifugation to settle into a layer of sediment along the inner surface thereof. By differential rotation of the worm conveyor and the bowl, the sediment is pushed or scrolled to a cake discharge opening at the smaller, conical end of the bowl. Additional discharge openings are provided in the bowl, usually at an end opposite of the conical section for discharging a liquid phase separated from the solid particles in the centrifuge.

One of the goals in centrifuge operation is to produce cakes with a low moisture content. One proposed method, published in Research Disclosure, March 1993, Number 347, for reducing cake moisture content entails the disposition of a flow control structure proximate to the cake discharge port to reduce the volume flow rate of the cake by 25% to 75%. The flow control structure could be a ring shaped darn extending radially outwardly from the axis of the bowl, a dam disposed between two turns or wraps of the conveyor, an increased beach climb angle, an increased conveyor blade thickness, or an increased or decreased conveyor helix angle. It was asserted that by decreasing the volume flow rate of the solids by about one-half, or between 25% and 75%, the velocity at the interface between the liquids and the sedimented solids is in the reverse direction, i.e., towards the pool and away from the cake discharge port. Liquid from the pool and liquid expressed from the cake layer are drained back into the pool rather than carried out of the bowl with the sedimented solids. This is typical of a fluid-like cake.

For a cake which has a consistency such that it behaves more like a solid or granular solid as opposed to a fluid, the additional resistance imposed at the cake discharge end of the centrifuge bowl results in a thicker cake layer there as well as generally along the entire beach. A thicker cake leads to a higher compaction pressure under centrifugal force. Also, additional re-circulation of the cake in the beach is deemed possible which results in longer cake retention time before discharge of the cake from the centrifuge. Both higher compaction pressure and longer retention time would effect better liquid expression from the cake, resulting in drier cake.

In consequence, with proper control of cake flow rate, drier cake can be obtained irrespectively of the nature of the cake, whether it be a solid-like or fluid-like cake.

It is also known to form a dip weir along the outer surface of the conveyor hub, at or about the location of the junction between the cylindrical and conical sections of the bowl, to serve in selecting the driest portion of the cake at the discharge end of the bowl. The dip weir blocks the transport of the sludge cake in such a manner that the most compacted part of the cake, adjacent to the inner bowl surface, passes under the dip weir and reaches the cake discharge opening. In conventional practice, the dip weir is fixed to the hub so that the radial gap between the outer edge of the dip weir and the inner surface of the bowl is constant or fixed. The designer must position and dimension the weir to minimize cake moisture content while not increasing cake transport resistance through the gap so as to unduly limit the solids capacity of the machine. The optimal gap height depends on the nature of the cake, the G-level, and the cake flow rate or solids throughput. The designer is forced to guess at the appropriate gap height, guided somewhat by past experience. If the gap height is guessed incorrectly owing to variability or uncertainty of the feed properties, the process results are compromised. Another expensive iteration is repeated wherein the conveyor has to be removed from the bowl-conveyor-gear/backdrive assembly. The existing dip weir or baffle would be replaced with another one of a different size to provide a different gap height prior to reassembling the machine. Not only is there a cost issue, there is also time loss which could be critical. Based on field experience, the optimal gap changes with needs. The driest cake at a moderate throughput rate requires the smallest gap, whereas moderately dry cake at the highest throughput rate demands a wider gap. This need may vary with time and circumstances, rendering it difficult to predetermine an universally optimal gap.

An object of the present invention is to provide another option for controlling cake moisture content, which could be possibly less expensive and more flexible than previously proposed systems. The problem is to provide a cake flow control structure which allows for adjustability, to accommodate cakes of different compositions and rheological behavior. The adjustability should preferably be finely controllable and easily accessible for adjustment or repair.

SUMMARY OF THE INVENTION

A decanter centrifuge comprises, in accordance with the present invention, a bowl having a cake discharge opening at one end and a liquid phase discharge opening. The bowl is rotatable about a longitudinal axis, while the cake discharge opening is disposed in a plane oriented transversely relative to the longitudinal axis. The bowl has a cylindrical portion and a conical beach portion between the cylindrical portion and the cake discharge opening. A conveyor is disposed at least partially inside the bowl for rotation about the longitudinal axis at an angular speed different from an angular rotational speed of the bowl. The conveyor includes a helical screw disposed inside the bowl for scrolling a deposited solids cake layer along an inner surface of the bowl towards the cake discharge opening. A feed accelerator system is disposed between the conveyor and the bowl for delivering an accelerated feed slurry into a pool inside the bowl. Pursuant to the invention, a flow control structure is provided on the bowl at the cake discharge opening for varying the cross-sectional area of the cake discharge opening to selectively impede a flow of cake along the bowl towards the cake discharge opening.

In accordance with a feature of the present invention, the bowl includes a body portion and a bowl head removably affixed to the body portion. The cake discharge opening is provided in the bowl head. Where the bowl head has a cylindrical wall and a transverse end wall, the cake discharge opening is advantageously disposed in the cylindrical wall. In that event, the flow control structure may include a sleeve attached to the bowl head for positioning at different locations along the longitudinal axis or along the circumference. The sleeve may be positioned manually, or automatically (electrically or hydraulically) in response to an instruction or actuation of a control by an operator. In the case of automatic sleeve positioning, based on the measured cake dryness and throughput, the positioning may be implemented during operation of the centrifuge, i.e., during rotation of the bowl and the conveyor.

Of course, the cake discharge opening may be disposed in a cylindrical wall at the one end of the bowl even where the bowl does not have a detachable head.

Preferably, there is a plurality of cake discharge openings, the openings are angularly equispaced about the longitudinal axis of the centrifuge. This feature facilitates or enables balancing of the centrifuge.

In accordance with another embodiment of the present invention, the flow control structure includes a closure element pivotably attached to the bowl at the cake discharge opening. The closure element may be slidably mounted to the bowl or bowl head for shifting parallel to the axis of the centrifuge. Alternatively, the closure element may be pivotably mounted about the axis of the cake discharge opening.

In a method for operating a decanter type centrifuge in accordance with the present invention, a bowl and a conveyor are rotated about a longitudinal axis at different rotation speeds. The bowl has at least one cake discharge opening at one end. The bowl also has one or more liquid phase discharge openings. In addition, the bowl incorporates a cylindrical portion and a beach portion between the cylindrical portion and the cake discharge opening. A flow control structure is provided at the cake discharge opening. During the rotating of the bowl and the conveyor, an accelerated feed slurry is delivered to an annular liquid pool in the bowl, while a cake layer is scrolled via the screw conveyor along an inner surface of the bowl towards the cake discharge opening. The cake is discharged from the bowl through the cake discharge opening and a liquid phase exits the bowl through the liquid phase discharge openings. The flow control structure is adjusted, in accordance with the invention, to change a cross-sectional area of the cake discharge opening, thereby modifying the impedance to cake flow along the beach to the cake discharge opening. This results in drier cake solids at small to minimal reduction in solids throughput. Additional adjustment of the control structure can be made if further cake dryness is desired.

Where the bowl includes a cylindrical wall at the one end and the cake discharge opening is provided in the cylindrical wall, the flow control structure may include a sleeve slidably mounted to the bowl. In one design, the adjusting of the flow control structure includes moving and repositioning the sleeve along the longitudinal axis. In another design, the adjustment of the flow control includes angularly or circumferentially moving and repositioning a sleeve about the axis of the machine. This moving and repositioning of the sleeve may be accomplished through an automatically operating adjustment mechanism during rotation of the bowl and the conveyor. The operator needs only to operate an actuator or generates a control signal to effectuate the adjustment in the cross-sectional area of the cake discharge opening.

Of course, adjusting the flow control structure may be implemented manually. An operator arrests the rotation of the bowl and the conveyor and reaches in through an access port in the machine casing to manually adjust the position of the flow control structure relative to the bowl or bowl head. The access port may be disposed at the end of the machine, in a transverse end face, or, alternatively, in a lateral casing panel near the end of the casing.

Where the cake discharge opening is one of a plurality of openings angularly equispaced about the longitudinal axis and having respective cross-sections, the adjusting of the flow control structure may include changing the cross-sections of the cake discharge openings substantially equally so that the cross-sections retain the same size and shape. In a specific embodiment of the invention, each cake discharge opening is provided with a respective closure or valve element. These closure or valve elements may be manually or automatically shifted to change the cross-sections of the cake discharge openings. Where the closure or valve elements are pivotably attached to the bowl at respective cake discharge openings, the adjusting of the flow control structure includes pivoting the closure element by a common angular displacement.

A cake flow control structure in accordance with the present invention results in an improved conveyance of sludge in a centrifuge machine. The adjustability of the cross-sectional area of the cake discharge openings enables one to "tune" a decanter centrifuge to optimize the cake profile at the discharge end of the bowl so that liquid expressed from the cake runs back into the slurry pool. Also, this prevents pool liquid from being carried with the cake to the solid discharge end as the cake emerges out of the liquid pool.

A cake flow control structure in accordance with the present invention is especially effective where the bowl has a compound beach with two discrete beach angles, i.e., a steep first beach of 10–25 degrees with respect to the longitudinal axis of the machine and a generally horizontal second beach of zero degrees with respect to the longitudinal axis of the machine. Typically, the pool is set to overlap the first beach and not the second beach.

It is to be noted that the cake discharge opening(s) may be provided in a transverse end face of the bowl (or bowl head), which is oriented perpendicularly to the axis of the centrifuge. Again, the cake discharge opening or openings are provided with closure elements for effectuating a change in discharge opening cross-section. Providing the cake discharge opening(s) in a cylindrical wall of the bowl may be preferable for purposes of reducing wear. The bowl head is a solid or integral piece with high-wear areas protected with wear-resistant materials.

DESCRIPTION OF THE PREFERRED EMBODIMENTS

Figure 1:
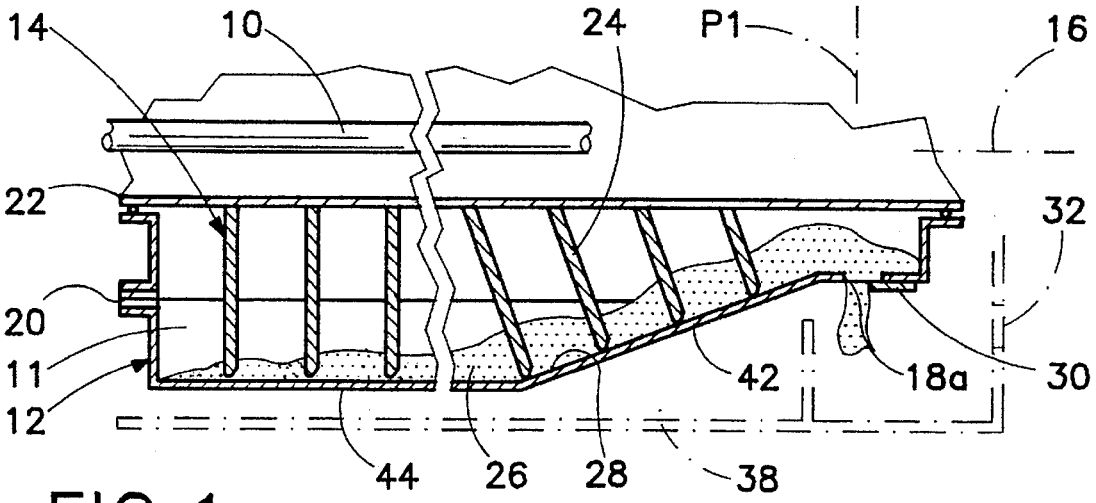
FIG. 1 is a schematic partial longitudinal cross-sectional view of a decanter centrifuge in accordance with the present invention.

FIG. 1 diagrammatically illustrates the lower half of a decanter type centrifuge comprising a solid bowl 12, a worm or screw type conveyor 14, and a slurry feed arrangement that includes a feed pipe 10, a feed compartment (not shown) and one or more openings (not shown) in the conveyor hub 22 to allow slurry to pass from the feed compartment to a liquid pool 11 in the bowl. Bowl 12 is rotatable about a longitudinal axis 16 and has a plurality of cake discharge openings 18*a*, 18*b* (see FIG. 2) at one end and a liquid phase discharge opening 20 at an opposite end. Conveyor hub 22 has at least a portion disposed inside bowl 12 for rotation about longitudinal axis 16 at an angular speed different from an angular rotational speed of bowl 12. Conveyor 14 further includes a helical screw or worm 24 attached to conveyor hub 22 and disposed inside bowl 12 for scrolling a cake layer 26 along an inner surface 28 of bowl 12 towards cake discharge openings 18*a*, 18*b*. An adjustable component 30 on bowl 12 at the cake discharge end thereof serves to modify the total or composite cross-sectional area of the cake discharge openings 18*a*, 18*b*, thereby modifying the impedance to the flow of cake towards the discharge openings 18*a*, 18*b*. This adjustability enables an optimization of the moisture content of cake exiting bowl 12 at cake discharge openings 18*a*, 18*b* or other performance parameters.

Figure 2:
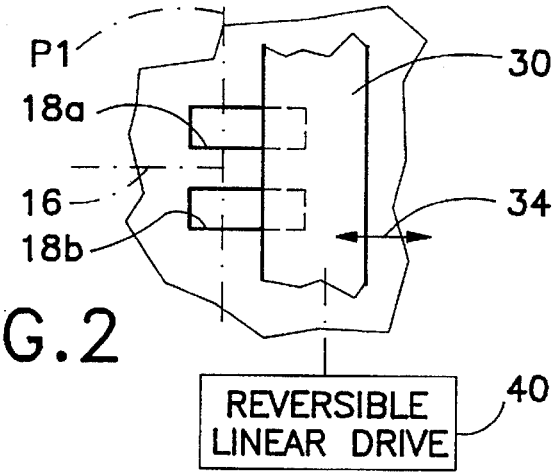
FIG. 2 is a diagram showing, in a planar view, a plurality of cake discharge openings disposed in a cylindrical wall of the centrifuge of FIG. 1.

As depicted schematically in FIG. 2, cake discharge openings 18*a*, 18*b* etc. are disposed in a plane P1 oriented transversely to longitudinal axis 16. Openings 18*a*, 18*b* are mutually equispaced about axis 16 to facilitate balancing of the centrifuge during operation. For the same reason, any modification in the cross-sections (especially the cross-sectional areas) of the cake discharge openings should be the same. These principles apply to all of the centrifuge embodiments disclosed herein.

Preferably, adjustable component 30 takes the form of a sleeve movably mounted to bowl 12 for selective positioning along axis 16, as indicated by a double-headed arrow 34. Depending on the location of the adjustable component (sleeve) 30 relative to cake discharge openings 18*a*, 18*b*, the openings have larger or smaller cross-sections and, concomitantly, present reduced or increased resistance to cake flow. Locking hardware (not shown) may be provided for maintaining adjustable component (sleeve) 30 at a selected location along axis 16.

The position of cake-flow control component 30 along axis 16 may be adjusted manually by arresting the rotation of bowl 12 and conveyor 14 and reaching through an access port 32 in a stationary housing or casing 38 (FIG. 1). Alternatively, the position of component 30 may be adjusted automatically by a reversible linear drive 40 (FIG. 2) such as one or more hydraulic cylinders or one or more solenoids. In the latter case, it is possible to adjust the effective cross-sectional areas of cake discharge openings 18*a*, 18*b* and thus modify the impedance to cake flow during the operation of the machine.

As shown in FIG. 1, bowl 12 is formed with a beach section 42 extending between a cylindrical main body portion 44 of the bowl and the cake discharge openings 18*a*, 18*b*.

Figure 3:
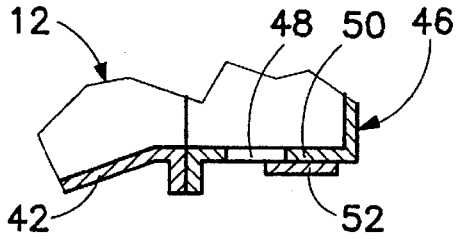
FIG. 3 is a schematic partial longitudinal cross-sectional view showing a modification of the decanter centrifuge of FIG. 1.

FIG. 3 illustrates a modification of the decanter centrifuge of FIG. 1 wherein bowl 12 is provided at its cake discharge end with a detachable bowl head 46. Bowl head 46 is formed with cake discharge openings 48 in a cylindrical side wall 50. Again, a closure element such as a sleeve 52 is movably mounted to bowl head 46 for shifting in a longitudinal direction to adjust the cross-sections of the individual cake discharge openings 48 and thus the total or composite cross-sectional area thereof. As discussed above with reference to FIGS. 1 and 2, the positional adjustment of sleeve 52 may be effectuated manually or through a servomechanism. It is to be further noted that cake-flow control component 30 or sleeve 52 may be a plurality of closure separately adjustable closure elements equal in number to openings 18*a*, 18*b* or 48. Positional adjustment of the individual closure elements may be effectuated manually during an interruption in centrifuge operation or automatically during centrifuge operation.

Figure 4:
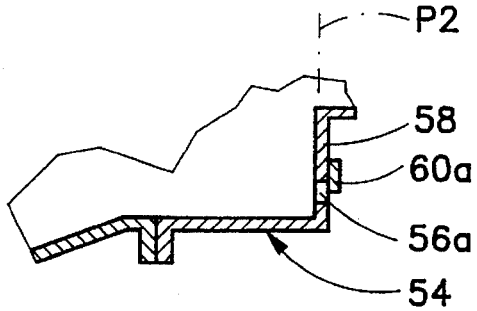
FIG. 4 is a schematic partial longitudinal cross-sectional view showing another modification of the decanter centrifuge of FIG. 1.
Figure 5:
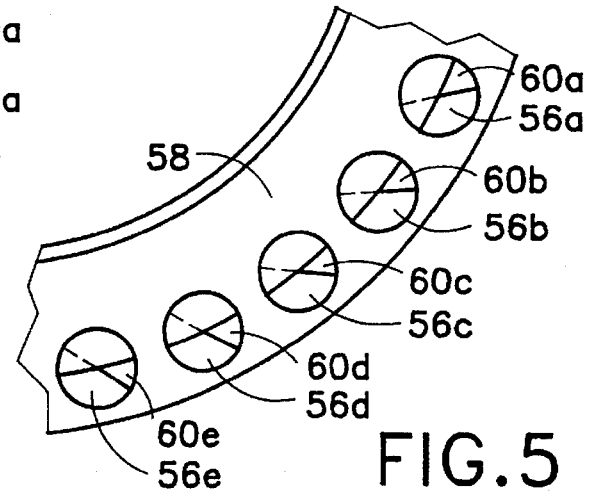
FIG. 5 is a partial end elevational view of a bowl head illustrated in FIG. 4.

FIGS. 4 and 5 depict another modification of the decanter centrifuge of FIG. 1 wherein bowl 12 is not only provided at its cake discharge end with a detachable bowl head 54 but a plurality of cake discharge openings 56*a*–56*e* are disposed in a transverse end wall 58 of the bowl head. End wall 58 and openings 56*a*–56*e* lie in a plane P2 oriented transversely to the bowl and conveyor rotation axis of the centrifuge. As discussed above, openings 56*a*–56*e* are mutually equispaced about axis 16 to facilitate balancing of the centrifuge during operation. A plurality of separately adjustable closure elements 60*a*–60*e* are pivotably movably mounted to bowl head 54 for turning about respective rotation axes (not shown) to adjust the cross-sections of the individual cake discharge openings 56*a*–56*e* and thus the total or composite cross-sectional area thereof. Generally, adjusting the angular orientations of closure elements 60*a*–60*e* is implemented manually by reaching in through an access port in the machine casing.

Figure 6:
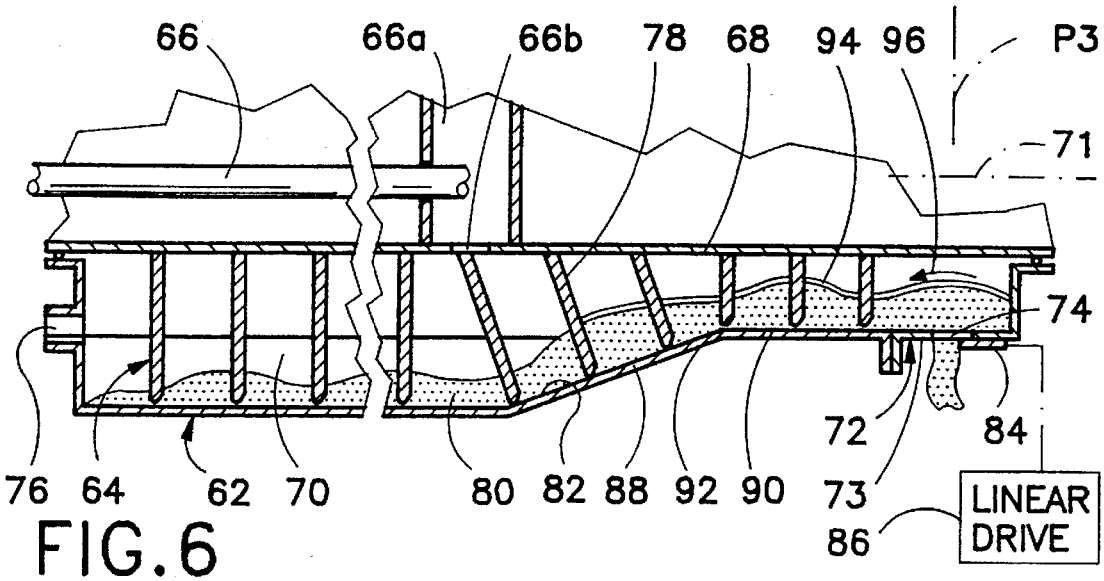
FIG. 6 is a schematic partial longitudinal cross-sectional view, similar to FIG. 1, of another decanter centrifuge in accordance with the present invention.

FIG. 6 diagrammatically illustrates another decanter type centrifuge comprising a solid bowl 62, a worm or screw type conveyor 64, and a slurry feed arrangement that includes a feed pipe 66, a feed compartment 66*a* and one or more openings 66*b* in the conveyor hub 68 to allow slurry to pass from the feed compartment 66*a* through the openings 66*b* to a liquid pool 70 in the bowl. Bowl 62 is rotatable about a longitudinal axis 71 and has a bowl head 72 provided in a cylindrical wall 73 with a plurality of angularly equispaced cake discharge openings 74 disposed in a transverse plane P3. A liquid phase discharge opening 76 is provided at an end of bowl 62 opposite cake discharge openings 74. Conveyor hub 68 has at least a portion disposed inside bowl 62 for rotation about longitudinal axis 71 at an angular Speed different from an angular rotational speed of bowl 62. Conveyor 64 further includes a helical screw or worm 78 attached to conveyor hub 68 and disposed inside bowl 62 for scrolling a cake layer 80 along an inner surface 82 of bowl 62 towards cake discharge openings 74. An adjustable component 84 such as a sleeve is movably mounted to bowl 62 at the cake discharge end thereof for modifying the cross-sections of openings 74 and, concomitantly, the total or composite cross-sectional area thereof, thereby modifying the impedance to the flow of cake towards the discharge openings 74. This adjustability enables an optimization of the moisture content of cake exiting bowl 62 at cake discharge openings 74 or other performance parameters.

As in the embodiment of FIG. 1, the location of the adjustable sleeve 84 relative to cake discharge openings 74 substantially determines the resistance to cake flow. Locking hardware (not shown) may be provided for maintaining adjustable component (sleeve) 84 at a selected location gong axis 71.

The position of cake-flow control component 84 along axis 71 may be adjusted manually by arresting the rotation of bowl 62 and conveyor 64 and reaching through an access port (not shown in FIG. 6) disposed in an end wall or a side wall near the end of a stationary housing or casing. Alternatively, the position of component 84 may be adjusted automatically by a reversible linear drive 86 such as one or more hydraulic cylinders or one or more solenoids. In the latter case, it is possible to adjust the effective cross-sectional areas of cake discharge openings 74 and thus modify the impedance to cake flow during the operation of the machine.

As shown in FIG. 6, bowl 62 is formed with a compound beach including a steep first beach section 88 having an angle of inclination of 10°–25° relative to axis 71 and a generally horizontal second beach section 90 having a generally zero slope. Liquid phase discharge opening 76 and a junction 92 between beach section 88 and 90 are located at approximately the same distance from axis 71. Thus, pool 70 is set to overlap beach section 88 and not beach section 90. The pool 70 provides bouyancy which assists in conveying cake 80 up beach section 88.

During operation of the centrifuge of FIG. 6, cake builds up at its own natural angle over flat beach section 90. The angle of inclination is determined in part by the impedance to cake flow presented by the cross-sections of the cake discharge openings 74. Owing to this inclination of the cake layer, liquid 94 expressed from the cake runs back into pool 70, as indicated by an arrow 96. In the case of fluid-like cake, the surface of cake with a significant thickness might have a velocity component directed backward, carrying expressed liquid back into the pool.

Figure 7A:
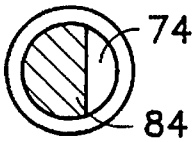
FIGS. 7A and 7B are plan views of a cake discharge opening in a particular embodiment of the decanter centrifuge of FIG. 1 or FIG. 6, showing the cake discharge opening with different cross-sections in accordance with the present invention.
Figure 7B:
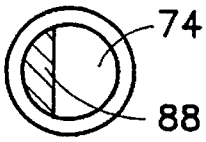

Cake discharge openings 74 may be generally rectangular (FIG. 2) or generally circular as shown in FIGS. 7A and 7B. In FIG. 7A, openings 74 have a relatively small cross-sectional are, i.e., are relatively closed by the positioning of adjustable sleeve 84. In FIG. 7B, openings 74 have relatively, large cross-sectional areas.

Figure 8:
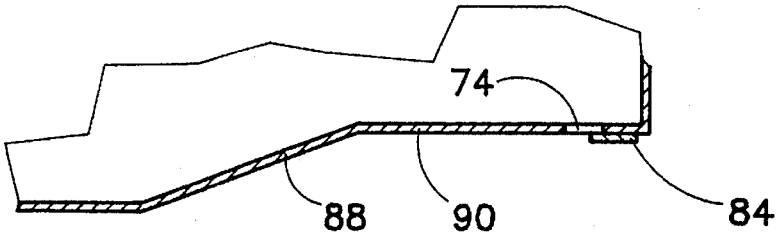
FIG. 8 is a schematic partial longitudinal cross-sectional view showing a modification of the decanter centrifuge of FIG. 6.
Figure 9:
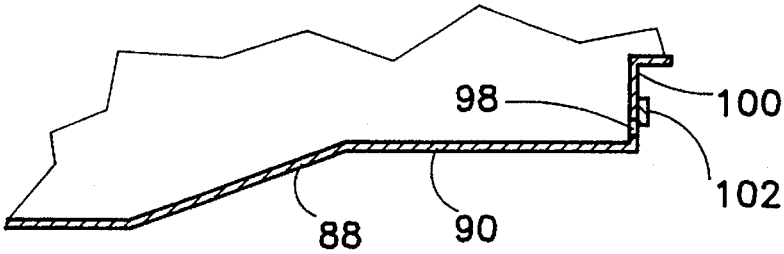
FIG. 9 is a schematic partial longitudinal cross-sectional view showing another modification of the decanter centrifuge of FIG. 6.
Figure 10:
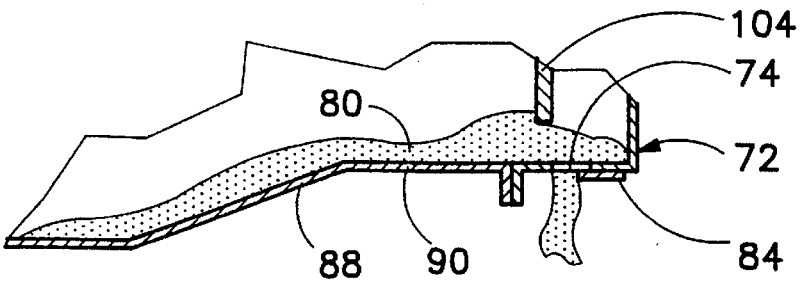
FIG. 10 is a schematic partial longitudinal cross-sectional view showing a further modification of the decanter centrifuge of FIG. 6.

FIG. 8 illustrates a modification of the embodiment of FIG. 6 wherein bowl 62 is a single solid piece at the cake discharge end, i.e., there is no bowl head. FIG. 9 shows a modification of the embodiment of FIG. 8 wherein cake discharge openings 98 are provided in a transverse end wall 100 of the bowl. Closure elements 102 are as described hereinabove with reference to FIG. 4. FIG. 10 depicts a further modification of the embodiment of FIG. 6 wherein a cake baffle 104 coupled to conveyor hub 68 is disposed immediately upstream of cake discharge openings 74. The cake layer 80 flows under baffle 104 and through discharge openings 74 in bowl head 72. The baffle 104 provides a fixed cake-flow restriction which is followed by an adjustable cake-flow restriction in the form of openings 74 and sleeve 84. The adjustable cake-flow restriction fine tunes the flow restriction imposed by baffle 104.

Figure 12:
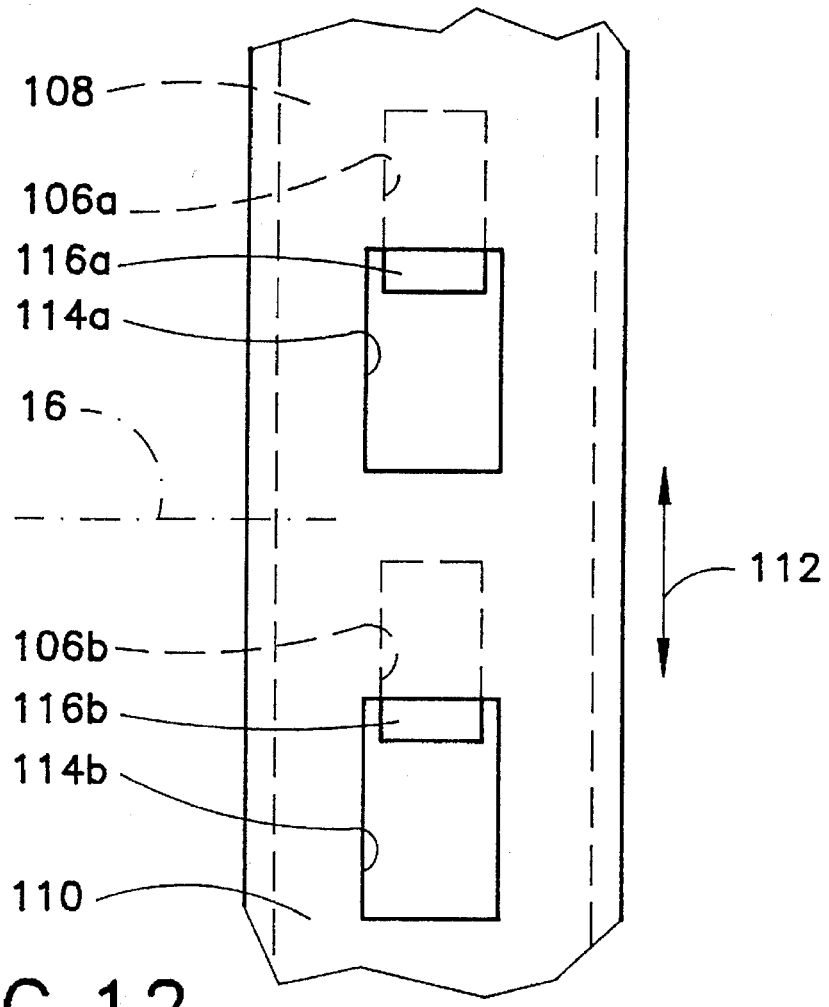
FIG. 12 is a diagram showing, in a planar view, a plurality of cake discharge openings disposed in a cylindrical wall of a decanter centrifuge in accordance with the embodiment of FIG. 11.
Figure 11:
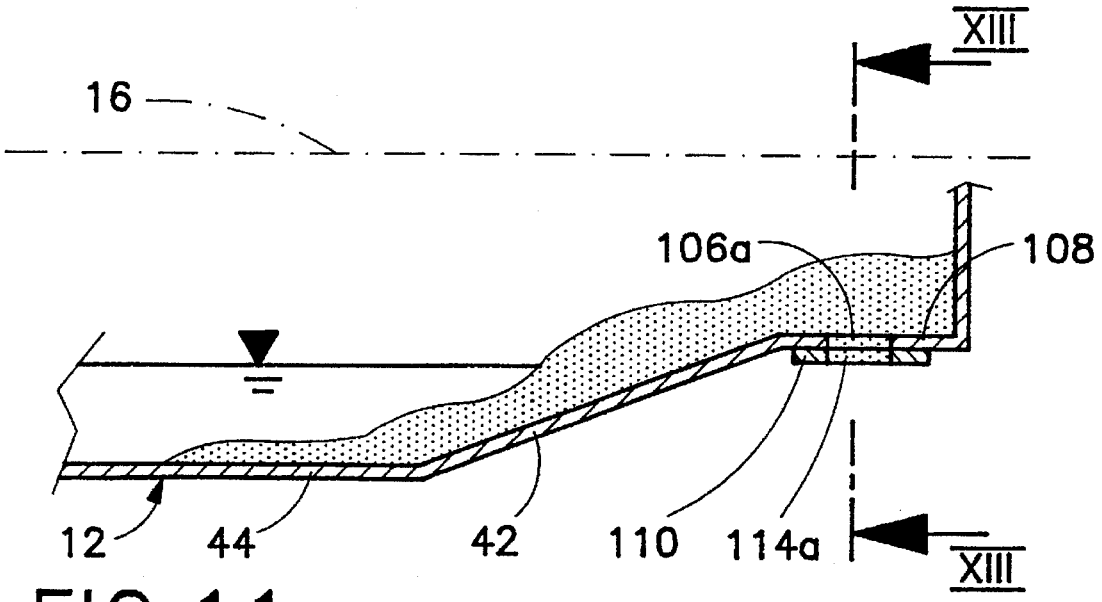
FIG. 11 is a schematic partial longitudinal cross-sectional view showing yet another modification of the decanter centrifuge of FIG. 1.
Figure 13:
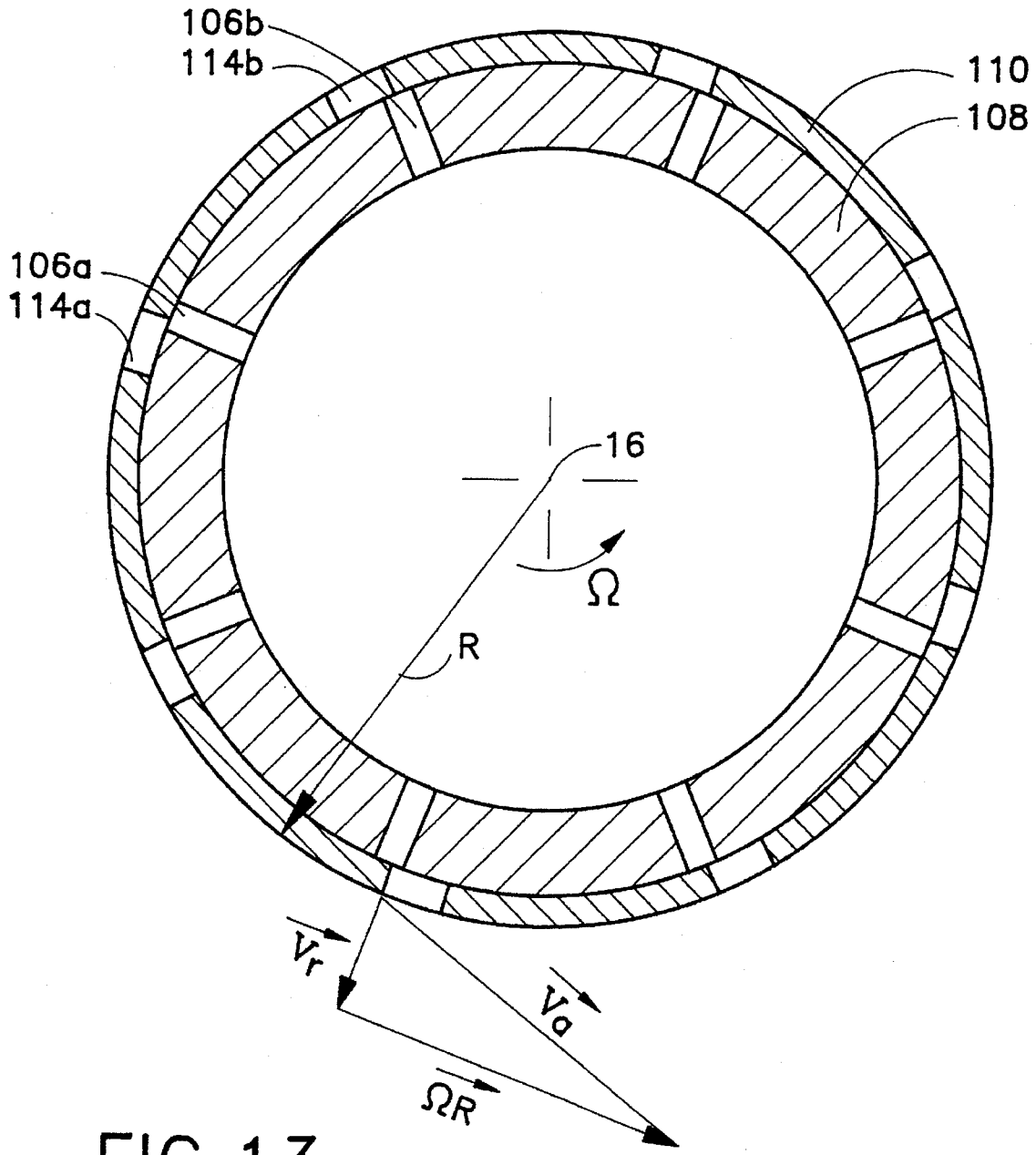
FIG. 13 is a schematic transverse cross-sectional view taken along line XIII—XIII in FIG. 11, with a vector diagram indicating the component velocity of cake exiting a discharge opening in the centrifuge bowl.

FIGS. 11–13 depict a further modification of the decanter centrifuge of FIG. 1 wherein bowl 12 is provided at its cake discharge end with a plurality of cake discharge openings 106*a*, 106*b*, etc., disposed in a cylindrical wall section 108. Openings 106*a*, 106*b*, etc., are mutually equispaced about axis 16 to facilitate balancing of the centrifuge during operation. A closure sleeve 110 is movably mounted to bowl 12 at cylindrical wall section 108 for turning about the centrifuge rotation axis 16, in a circumferential direction as indicated by a double-headed arrow 112 in FIG. 12, to adjust the cross-sections of the individual cake discharge openings 106*a*, 106*b*, etc., and thus the total or composite cross-sectional area thereof. More specifically, sleeve 110 is provided with a plurality of angularly equispaced apertures 114*a*, 114*b*, etc., which overlap with openings 106*a*, 106*b*, etc., to a variable extent to define respective flow ports 116*a*, 116*b*, etc., of adjustable area.

FIG. 13 shows a vector diagram where the net resultant cake velocity $\vec{v}_a$ with respect to a laboratory frame of reference is the vector sum of a first component $\vec{v}_r$ representing the velocity of exiting cake relative to the rotating bowl and a second component $\vec{\Omega R}$ representing the tangential or peripheral velocity of bowl 12, wherein Ω is the angular velocity of the bowl and R is the outer radius of bowl wall section 108. The composite or resultant absolute velocity $\vec{v}_a$ can be very high, resulting in a substantial wear of a stationary cake collection hopper which is subjected to impact and shear by a high velocity discharge of cake solids. Wear is especially pronounced when the cake flow is restricted: a cake head is built up inside the bowl 12 generates a high relative cake velocity $\vec{v}_r$.

Figure 14:
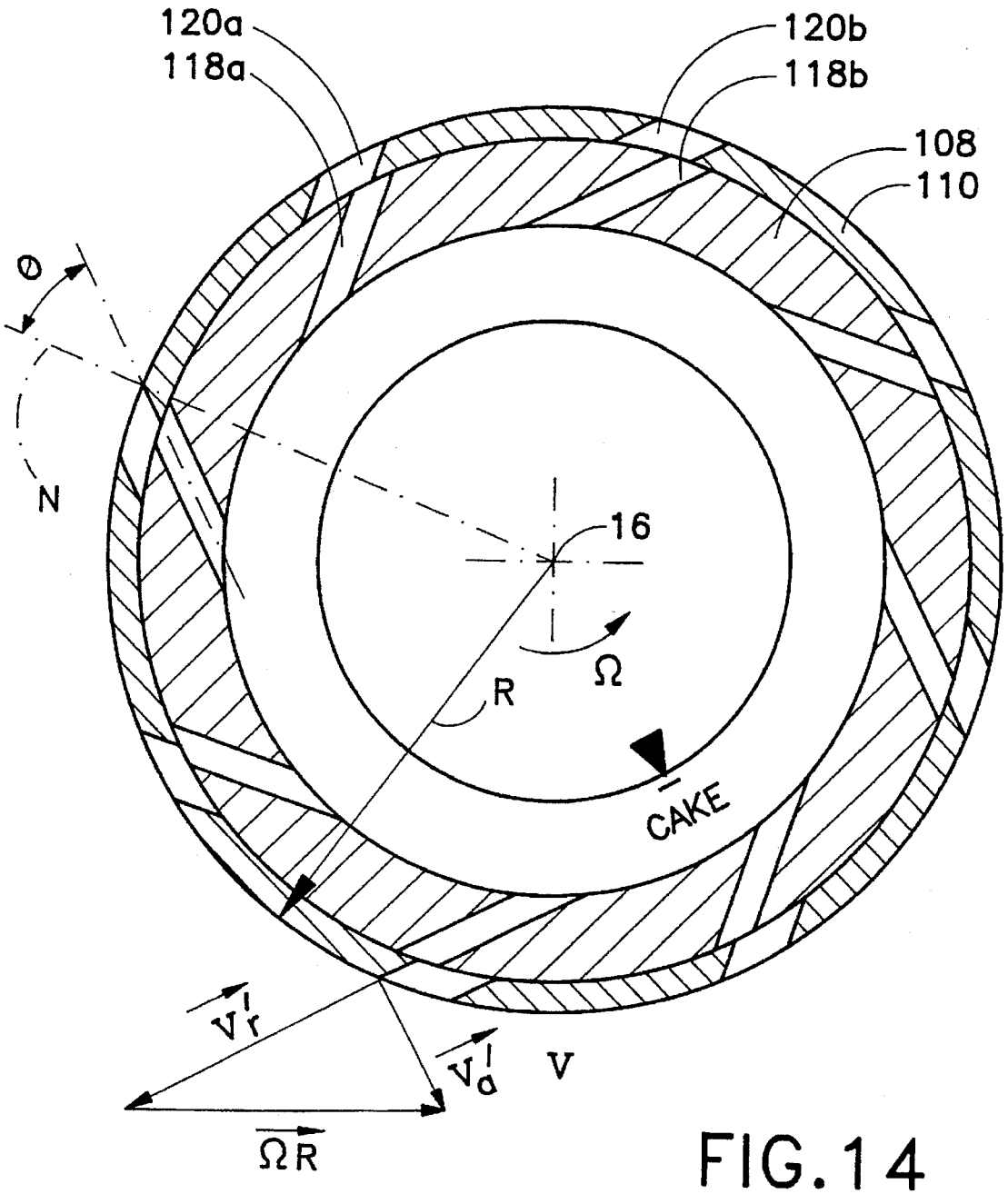
FIG. 14 is a schematic transverse cross-sectional view similar to FIG. 13, showing an altered cake discharge port design in accordance with the present invention.

FIG. 14 depicts an arrangement wherein the bowl wall 108 is provided with cake discharge openings 118*a*, 118*b*, etc., in the form of inclined channels angled back with respect to the rotation direction of bowl 12. The circumferentially repositionable closure sleeve 110 is similarly provided with angled apertures 120*a*, 120*b*, etc. The configuration of the discharge openings 118*a*, 118*b*, etc., in the embodiment of FIG. 14 results in a modified vector diagram where the relative cake velocity $\vec{v}_r'$ extends largely in a direction opposed to the tangential or peripheral velocity $\vec{\Omega R}$ of bowl 12. Accordingly, the magnitude of the composite or absolute cake velocity $\vec{v}_a'$ (relative to the laboratory) is substantially reduced. This reduction in output velocity offers a saving in energy and power for acceleration and decreases the cake's kinetic energy, which is proportional to the square of the cake's speed. This decrease in kinetic energy in turn reduces the wear on the hopper wall. Generally, where θ is the angle between a normal to the surface N and the axis of a channel 118*a*, 118*b*, etc., the best results are produced with the largest possible angle θ (up to 90°).

Figure 15:
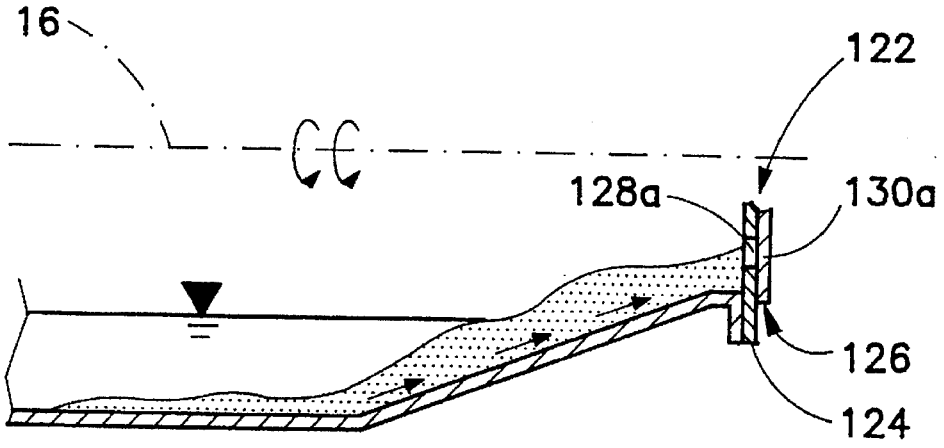
FIG. 15 is a schematic partial longitudinal cross-sectional view showing an additional modification of the decanter centrifuge of FIG. 1.
Figure 16:
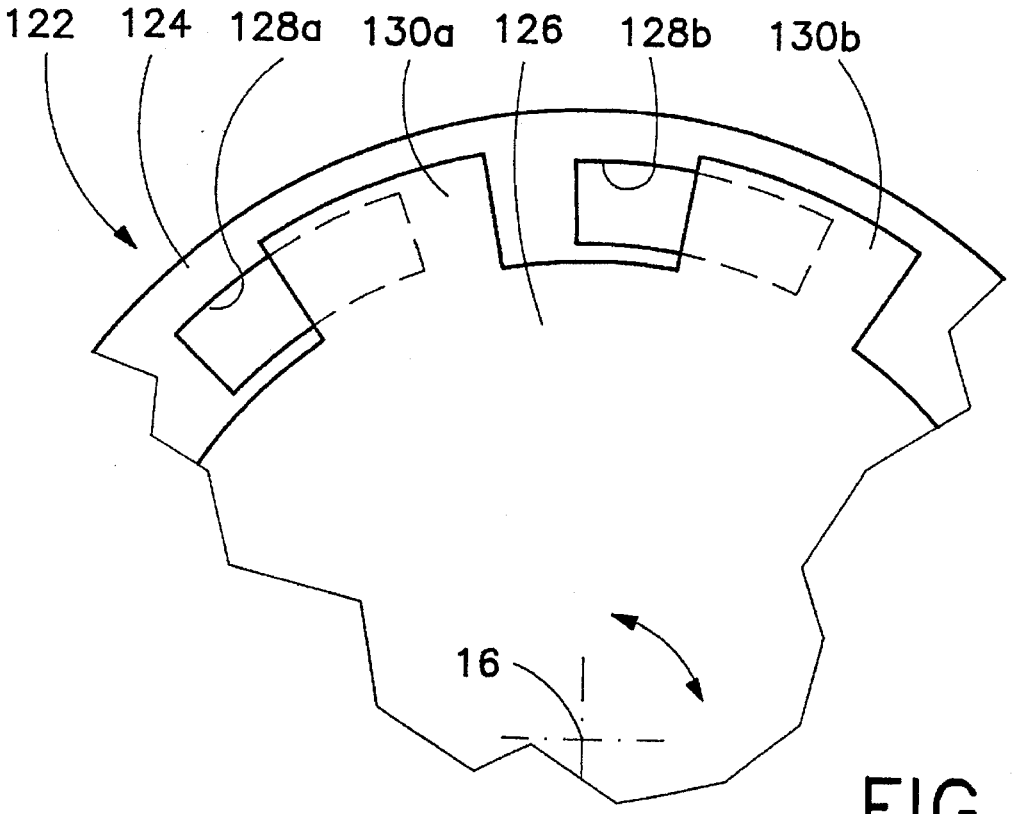
FIG. 16 is a schematic partial end view of the decanter centrifuge of FIG. 15.

As shown in FIGS. 15 and 16, bowl 12 is provided at its cake discharge end with a detachable bowl head 122 comprising two end caps or rings 124 and 126. Inner end cap or ring 124 is formed with a plurality of angularly equispaced cake discharge openings 128*a*, 128*b*, etc., while outer end cap or ring 126 is formed with a plurality of angularly equispaced outwardly extending tongues 130*a*, 130*b*, etc. Outer ring 126 is rotatably mounted with respect to machine axis 16 so that tongues 130*a*, 130*b*, etc. overlap openings 128*a*, 128*b*, etc., by adjustable amounts to vary the composite output flow cross-section area.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A decanter centrifuge comprising:

a bowl rotatable about a longitudinal axis, said bowl having a cake discharge opening at one end and a liquid phase discharge opening, said cake discharge opening being disposed in a plane oriented transversely relative to said longitudinal axis, said bowl having a cylindrical portion and a beach portion between said cylindrical portion and said cake discharge opening, said bowl including a body portion and a bowl head removably affixed to said body portion, said cake discharge opening being provided in said bowl head;

a conveyor having at least a portion disposed inside said bowl for rotation about said longitudinal axis at an angular speed different from an angular rotational speed of said bowl, said conveyor including a helical screw disposed inside said bowl for scrolling a deposited solids cake layer along an inner surface of said bowl towards said cake discharge opening;

a feed element for delivering a feed slurry into a pool inside said bowl; and a flow control structure provided on said bowl at said cake discharge opening for varying a cross-sectional area of said cake discharge opening, thereby selectively impeding a flow of cake along said bowl towards said cake discharge opening.

2. The centrifuge defined in claim 1 wherein said bowl head has a cylindrical wall and an end wall connected thereto and extending transversely to said longitudinal axis, said cake discharge opening being disposed in said cylindrical wall.

3. The centrifuge defined in claim 2 wherein said flow control structure includes a sleeve movably attached to said bowl head.

4. The centrifuge defined in claim 3 further comprising an actuation mechanism operatively connected to said flow control structure for automatically moving said sleeve during rotation of said bowl and said conveyor.

5. The centrifuge defined in claim 1, further comprising an actuation mechanism operatively connected to said flow control structure for automatically operating said flow control structure during rotation of said bowl and said conveyor.

6. The centrifuge defined in claim 1 wherein said cake discharge opening is one of a plurality of cake discharge openings which are angularly equispaced about said longitudinal axis.

7. The centrifuge defined in claim 1 wherein said flow control structure includes a closure element pivotably attached to said bowl at said cake discharge opening.

8. A method for operating a decanter type centrifuge, comprising: rotating a bowl about a longitudinal axis at a first rate of rotation, said bowl having a plurality of angularly or circumferentially spaced cake discharge openings at one end and a liquid phase discharge opening, said bowl having a cylindrical portion and a beach portion between said cylindrical portion and said cake discharge openings, said bowl also having a flow control structure in the form of a movable sleeve provided at said cake discharge openings, an adjustment mechanism being operatively connected to said flow control structure;

during said rotating, delivering a feed slurry to a pool in said bowl;

rotating a screw conveyor about said longitudinal axis at a second rate of rotation different from said first rate of rotation;

scrolling a cake layer via said screw conveyor along an inner surface of said bowl towards said cake discharge openings;

discharging cake through said cake discharge openings and a liquid phase through said liquid phase discharge opening in said bowl; and adjusting a position of said sleeve to change a cross-sectional area of said cake discharge openings, thereby providing a different impedance to cake flow along said beach to said cake discharge openings, the adjusting of the position of said sleeve including operating said adjustment mechanism.

9. The method defined in claim 8 wherein said cake discharge openings have respective cross-sections, the adjusting of the position of said sleeve including changing the cross-sections of said cake discharge openings substantially equally so that said cross-sections retain the same size and shape.

10. The method defined in claim 8 wherein the adjusting of the position of said sleeve is implemented during the rotating of said bowl and said conveyor, further comprising continuing to rotate said bowl and said conveyor after adjustment of the position of said sleeve.

11. The method defined in claim 8 wherein the adjusting of the position of said sleeve is implemented after the rotation of said bowl and the rotation of said conveyor have been stopped, further comprising continuing to rotate said bowl and said conveyor after adjustment of the position of said sleeve.

12. A decanter centrifuge comprising:

a bowl rotatable about a longitudinal axis, said bowl having a cake discharge opening at one end and a liquid phase discharge opening, said cake discharge opening being disposed in a plane oriented transversely relative to said longitudinal axis, said bowl having a cylindrical portion and a beach portion between said cylindrical portion and said cake discharge opening;

a conveyor having at least a portion disposed inside said bowl for rotation about said longitudinal axis at an angular speed different from an angular rotational speed of said bowl, said conveyor including a helical screw disposed inside said bowl for scrolling a deposited solids cake layer along an inner surface of said bowl towards said cake discharge opening;

a feed element for delivering a feed slurry into a pool inside said bowl; and a flow control structure provided on said bowl at said cake discharge opening for varying a cross-sectional area of said cake discharge opening, thereby selectively impeding a flow of cake along said bowl towards said cake discharge opening, said flow control structure including a closure element pivotably attached to said bowl at said cake discharge opening.

13. A decanter centrifuge comprising:

a bowl rotatable about a longitudinal axis, said bowl having a plurality of cake discharge openings at one end and a liquid phase discharge opening, said cake discharge openings being angularly spaced about said longitudinal axis and disposed in a plane oriented transversely relative to said longitudinal axis, said bowl having a cylindrical portion and a beach portion between said cylindrical portion and said cake discharge openings, said bowl having a cylindrical wall at said one end on a side of said beach portion opposite said cylindrical portion, said cake discharge openings being disposed in said cylindrical wall;

a conveyor having at least a portion disposed inside said bowl for rotation about said longitudinal axis at an angular speed different from an angular rotational speed of said bowl, said conveyor including a helical screw disposed inside said bowl for scrolling a deposited solids cake layer along an inner surface of said bowl towards said cake discharge openings;

a feed element for delivering a feed slurry into a pool inside said bowl; and a flow control structure provided on said bowl at said cake discharge openings for varying a cross-sectional area of said cake discharge openings, thereby selectively impeding a flow of cake along said bowl towards said cake discharge openings, said flow control structure including a sleeve movably attached to said bowl.

14. The centrifuge defined in claim 13 wherein said sleeve is movably attached to said bowl for repositioning in a circumferential or angular direction.

15. The centrifuge defined in claim 13 wherein said sleeve is movably attached to said bowl for repositioning in a longitudinal or axial direction.

16. The centrifuge defined in claim 13 wherein said bowl includes a body portion and a bowl head removably affixed to said body portion, said bowl head including said cylindrical wall, said cake discharge openings being provided in said bowl head, said sleeve being movably attached to said bowl head.

17. The centrifuge defined in claim 13, further comprising an actuation mechanism operatively connected to said flow control structure for automatically moving said sleeve during rotation of said bowl and said conveyor.

18. The centrifuge defined in claim 13 wherein said sleeve is juxtaposed to said cake discharge openings and overlaps said cake discharge openings at lower rates of cake flow along said bowl towards said cake discharge openings.

* * * * *